US006312305B1

(12) United States Patent
McCormick et al.

(10) Patent No.: US 6,312,305 B1
(45) Date of Patent: Nov. 6, 2001

(54) STRUCTURE-FORMING CONSTRUCTION ELEMENT FOR TOY LOG BUILDING SET

(75) Inventors: Mark McCormick, Sellersville; Michael D. DiLabio, Pottstown, both of PA (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

(21) Appl. No.: 09/666,109

(22) Filed: Sep. 20, 2000

(51) Int. Cl.[7] ..... A63H 33/08

(52) U.S. Cl. ..... 446/85; 446/106; 446/110; 446/476

(58) Field of Search ..... 446/85, 106, 110, 446/476

(56) References Cited

U.S. PATENT DOCUMENTS

| | | | | |
|---|---|---|---|---|
| D. 322,296 | | 12/1991 | Klitsner | D21/484 |
| D. 403,029 | | 12/1998 | Van Wagenen | D21/494 |
| 1,061,637 | * | 5/1913 | Schwarz | 446/476 X |
| 3,780,469 | | 12/1973 | Hancovsky | 446/127 |
| 3,866,338 | * | 2/1975 | Lou | 446/85 X |
| 4,193,221 | | 3/1980 | Beck | 446/105 |
| 4,270,304 | * | 6/1981 | Sofer | 446/106 |
| 4,521,203 | * | 6/1985 | Rothenberg | 446/106 |
| 4,556,394 | | 12/1985 | Chen | 446/124 |
| 5,073,138 | | 12/1991 | Klitsner et al. | 446/103 |
| 5,580,294 | * | 12/1996 | Briant | 446/476 X |
| 5,846,114 | | 12/1998 | Frandsen, II | 446/106 |

FOREIGN PATENT DOCUMENTS

| | | | | |
|---|---|---|---|---|
| 4688 | * | 5/1990 | (WO) | 446/106 |

* cited by examiner

*Primary Examiner*—John A. Ricci
(74) *Attorney, Agent, or Firm*—Schweitzer Cornman Gross & Bondell LLP

(57) ABSTRACT

A structure-forming construction element for a toy log building set, such as those sold under the well known "Lincoln Logs". The construction element, typically a molding of plastic material, is formed with a plurality of adjacent sockets for the reception and gripping of log elements in parallel, side-by-side relation. In a typical form, the construction element is positioned on a support, and the log elements are oriented vertically in the sockets provided. A second, similar construction element may be placed on top of the upper ends of the logs. Side walls of the sockets can be notched to provide a castellated appearance, such that a structure with vertically spaced construction elements and vertical log elements has the appearance of a castle tower.

7 Claims, 6 Drawing Sheets

STRUCTURE-FORMING CONSTRUCTION ELEMENT FOR TOY LOG BUILDING SET

BACKGROUND AND SUMMARY OF THE INVENTION

The present invention is directed generally to toy log building sets, particularly of the well known type marketed under the "Lincoln Logs" trademark. Typical Lincoln Logs construction sets utilize a multiplicity of individual log elements, provided with end notches adapted to interfit with similar end notches on other log elements arranged at 90° thereto. This well known arrangement enables a wide variety of log cabin-type structures to be assembled by arranging the log elements in a horizontal disposition, one above the other, with each pair of vertically stacked logs being interfitted with a log extending at right angles thereto. Such construction sets have been marketed for many years and are in widespread use.

In accordance with the present invention, log construction sets of the indicated type are modified and improved through the addition of molded plastic construction elements which are configured to engage the log elements at one or both ends to support individual log elements in a desired orientation. To particular advantage, the new construction element is arranged to engage and support log elements in a vertical orientation, to enable tower-like structures to be easily constructed using a plurality of vertically oriented log elements.

In accordance with one feature of the invention, a molded plastic construction element is provided which forms a plurality of adjacent sockets for the endwise reception of log elements. The sockets are arranged to grip the log elements both to retain them in position and preferably also to secure the log elements against rotation.

In accordance with another advantageous feature of the invention, the construction element is a tower-forming element having a plurality of upwardly opening sockets for reception of lower end portions of log elements, and further formed with suitable recess means in the bottom portion thereof. Accordingly, a tower structure may be formed by placing a first such construction element on a support and inserting therein a plurality of vertically oriented log elements. Thereafter, a second such element may be placed on top of the upper ends of the vertically oriented log elements, with the upper ends of the log elements being received in the bottom recess means of the upper element. In a particularly preferred embodiment of the invention, the upwardly opening log-receiving sockets of the construction elements are of a castellated contour such that a completed tower structure, with construction elements at the bottom and the top of vertically oriented log elements, has the appearance of a castellated tower.

Construction elements according to the invention may be provided in various configurations, such as semicircular, right angular, etc., to enable a variety of structures to be assembled using the new construction fittings.

For a more complete understanding of the above and other features and advantages of the invention, reference should be made to the following detailed description of preferred embodiments of the invention, and to the accompanying drawings.

DESCRIPTION OF PREFERRED EMBODIMENTS OF THE INVENTION

Figure 3:
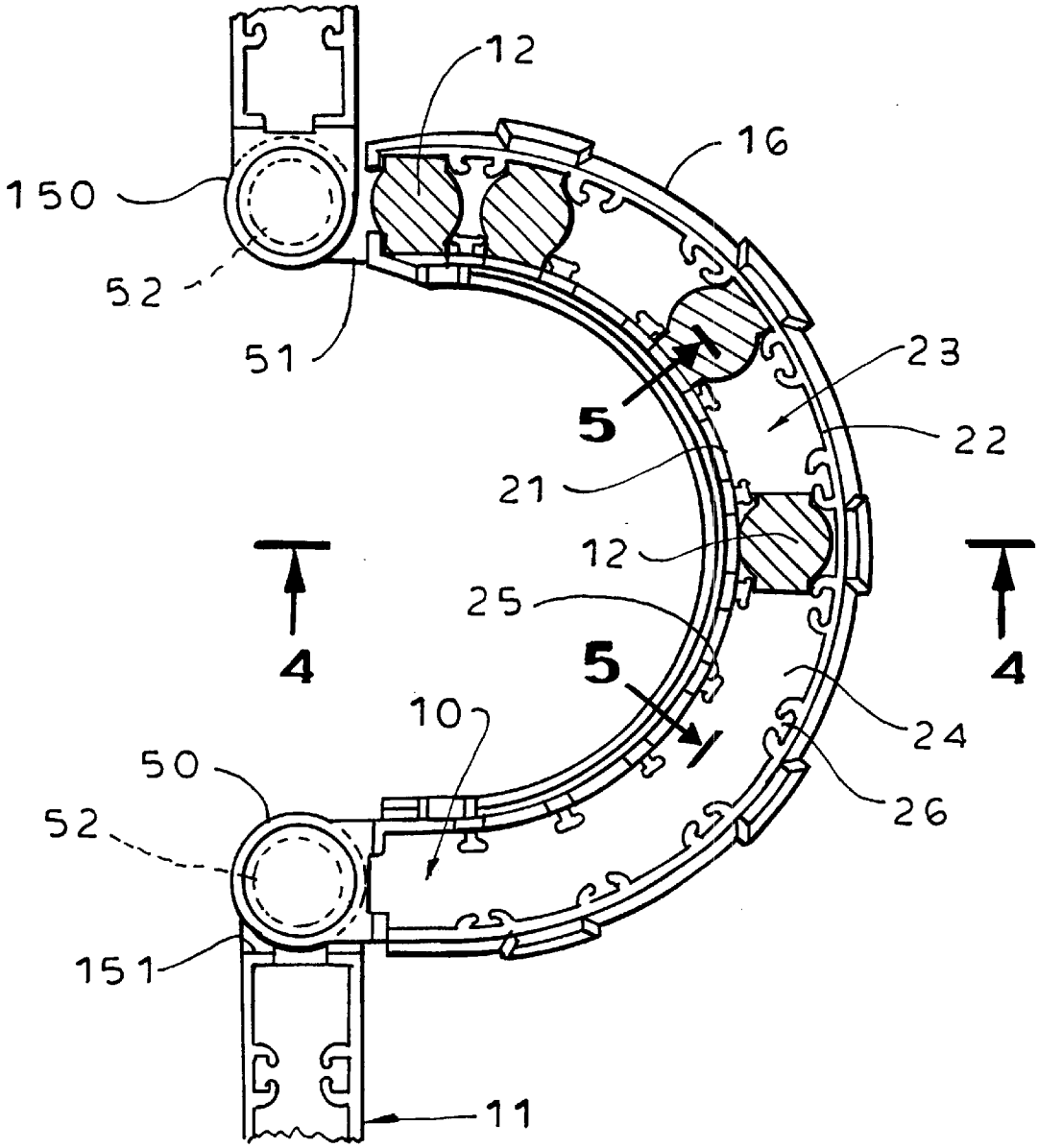
FIG. 3 is a top plan view, further illustrating the semicircular construction element partially shown in FIG. 2.

Referring now to the drawing, the reference numerals 10, 11 designate generally molded plastic construction elements according to the invention. The element 11 is shown as a right angular configuration, while the construction element 10 (FIG. 3) is of semicircular configuration. Within the contemplation of the invention, any suitable configuration may be utilized.

The construction elements 10, 11 are designed for cooperation with conventional toy log elements 12, such as are commonly provided in Lincoln Logs construction sets. These log elements are of generally circular cross section, although provided on opposite sides with flat surface projections 13 (FIGS. 4, 6) providing stable surfaces for stacking of logs horizontally one atop another. The cross sectional configuration, shown best in FIG. 6, typically extend throughout of the log elements, except for notches 14 provided adjacent each end. The length and depth of the notches 14 are such as to enable a pair of logs, stacked one atop the other, to receive the notched portion of a third log disposed at right angles, in a well known log cabin construction technique. In some cases, the log elements are formed of wood, but more typically of plastic material.

Figure 4:
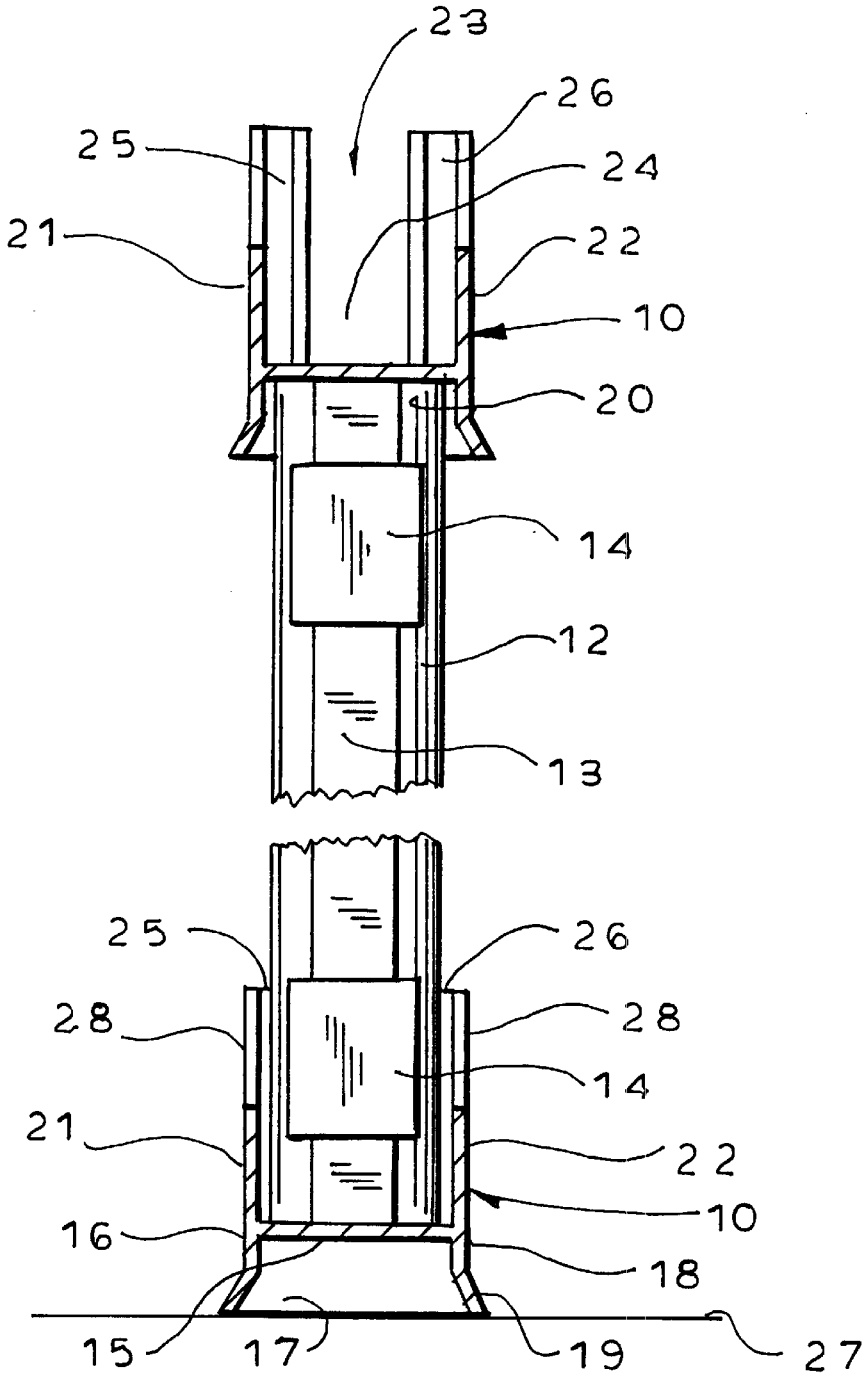
FIG. 4 is a cross sectional view as taken generally on line 4—4 of FIG. 3.
Figure 5:
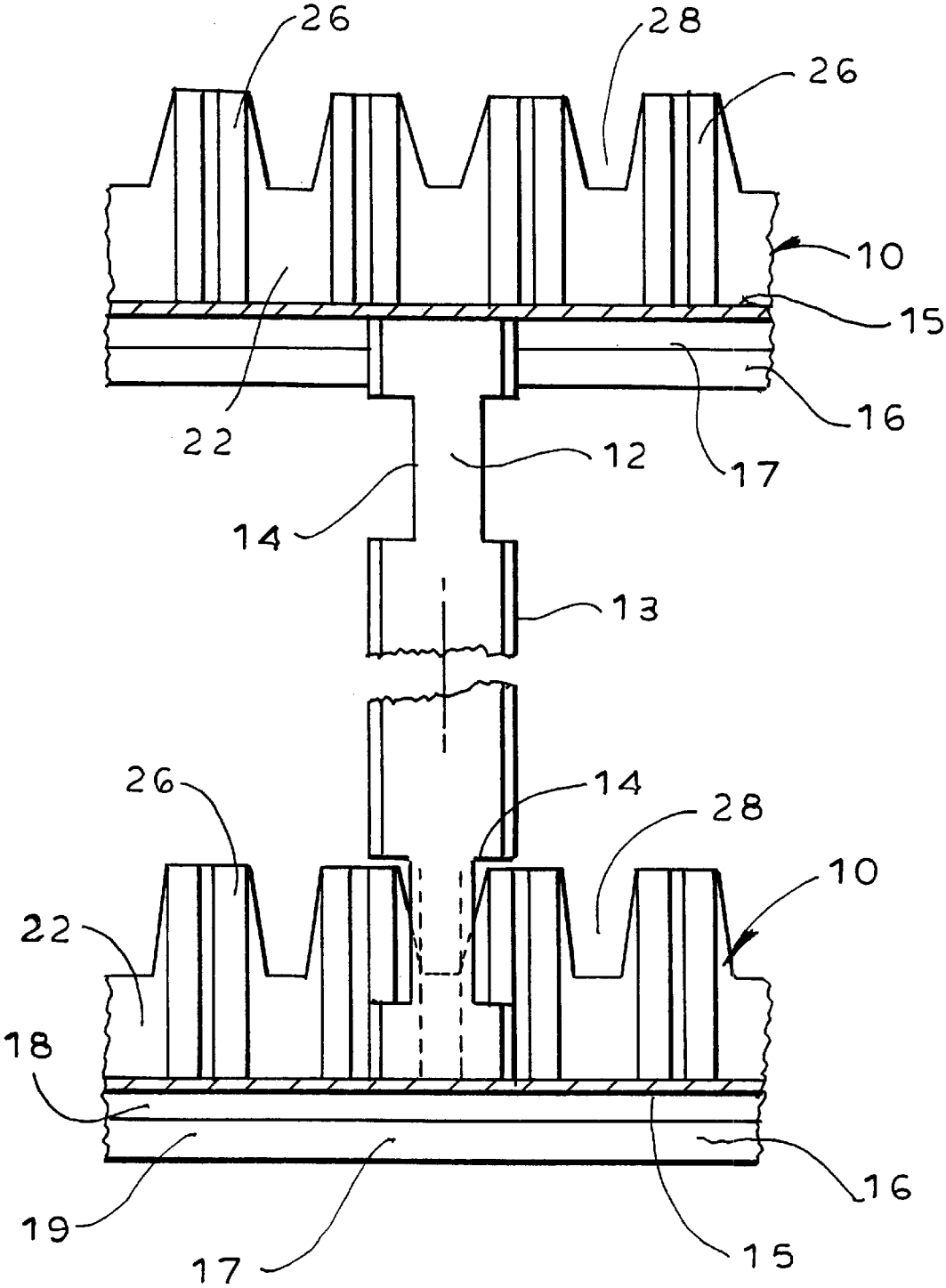
FIG. 5 is a fragmentary, developed cross sectional view as taken generally on line 5—5 of FIG. 3.

Referring initially to the semicircular form 10 of the construction element, shown particularly in FIGS. 3–6, the invention is shown in a structural arrangement comprising a pair of vertically spaced apart construction elements 10, with a plurality of logs 12, oriented vertically, extending therebetween (see particularly FIGS. 4 and 5). The construction element 10, which is formed of a molded plastic material, comprises a horizontal platform 15 of semicircular shape, supported by a semicircular base 16. The base 16, together with the platform 15, forms a downwardly opening channel 17 defined by generally vertical upper wall portions 18 and outwardly flared lower wall portions 18. The width of the upper portion of the channel 17, defined by the generally vertical wall portions 18, is the same as or slightly greater than the diametral dimensions of the log elements 12, in order to accommodate the reception of upper end portions 20 of log elements 12, generally as shown in FIG. 4.

In the illustrated form of the invention, the channel 17 is a simple semicircular channel, adapted to receive upper ends of the log elements at any point along its length. As will be understood and will become apparent, however, the channel 16 may, if desired, be formed to define individual sockets or receptacles for upper ends of the log elements, should that be desirable.

Above the horizontal platform 15, a construction element 10 is formed with spaced apart semicylindrical inner and outer walls 21, 22 extending generally vertically upward and forming an upwardly opening channel 23. The channel 23 is divided into a plurality of upwardly opening log-receiving sockets 24 by means of radially opposed inner and outer partitioning elements 25, 26.

Figure 6:
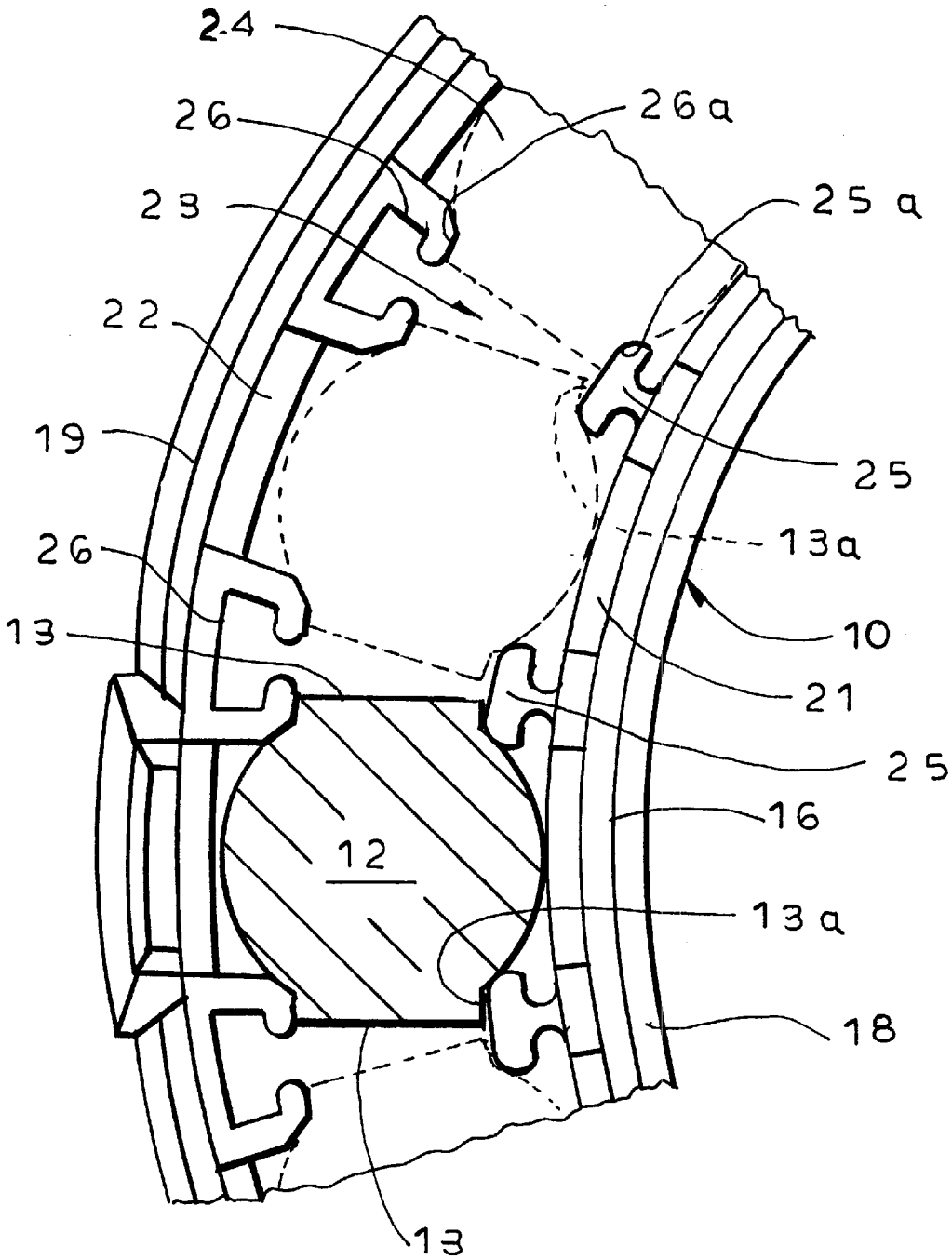
FIG. 6 is an enlarged, fragmentary top plan view of an arcuate section of the construction element of the invention, with a cross sectional view of a log element installed therein.

Preferably, and as shown particularly in FIG. 6, the spacing and configuration of the partitioning elements 25, 26 is such as to define individual, upwardly opening sockets 24 which closely receive the outer contours of a vertically oriented log element 12. Desirably, the configuration of the partitioning elements is such that inwardly facing surfaces 25*a*, 26*a* thereof cooperate with narrow side edge surfaces 13*a* of the elevated flat surface projections 13 of the log elements (see FIG. 6).

The arrangement is such that, with the log elements rotationally oriented with the flat surface projections 13 extending generally transversely of the channel 23, the side edge surfaces 13*a* are engaged by the partitioning elements to prevent rotation of the logs. Additionally, the radial distance between inner and outer walls 21, 22 of channel 23 is slightly greater than the spacing between opposed flat surface projections 13 of a log element, such that, if the log element is rotated to a position 90° to that shown in FIG. 6, the flat surface projections 13 will be confined by inner surfaces of the walls 21, 22, again preventing rotation of log elements 12, once installed in the sockets 20.

In a preferred embodiment of the invention, the inner and outer walls 21, 22 extend upwardly a distance sufficiently far to provide adequate grip and support of lower ends of log elements 12. Preferably, the logs are engaged for a distance somewhat greater than their diameter, for example, a wall height on the order of 3 cm is suitable for log elements of approximately 1.8 cm in diameter.

To assemble a structure utilizing the semicircular construction element 10, the element 10 may be placed on a flat support surface 27 (FIG. 4), and vertically oriented log elements, normally all of the same length, may be placed in some or all of the multiple sockets 24 formed by the partitioning elements 25, 26. Typically, most or all of the sockets are loaded with log elements.

To particular advantage, a tower-like structure can be formed by placing a second semicircular construction element 10 on top of the upstanding log elements, in the manner reflected in FIGS. 4 and 5. In the illustrated arrangement, in which the downwardly opening channel 17 of the upper construction element 10 is a continuous semicircular channel, the upper construction element is simply placed on top of the upper ends of the previously installed log elements. If desired, however, the downwardly opening channel 17 may be partitioned in the same manner as the upper channel 23, to form individual, downwardly opening sockets for engaging the log elements individually.

To particular advantage, the outer and/or inner walls 21, 22 of the construction element 10 may be notched, as at 28, between adjacent ones of the partitioning elements 25, 26 to provide a castellated configuration to the construction elements. When a tower-like structure is formed using upper and lower construction elements as shown in FIG. 5, for example, the completed structure resembles a castle tower, for example.

Figure 1:
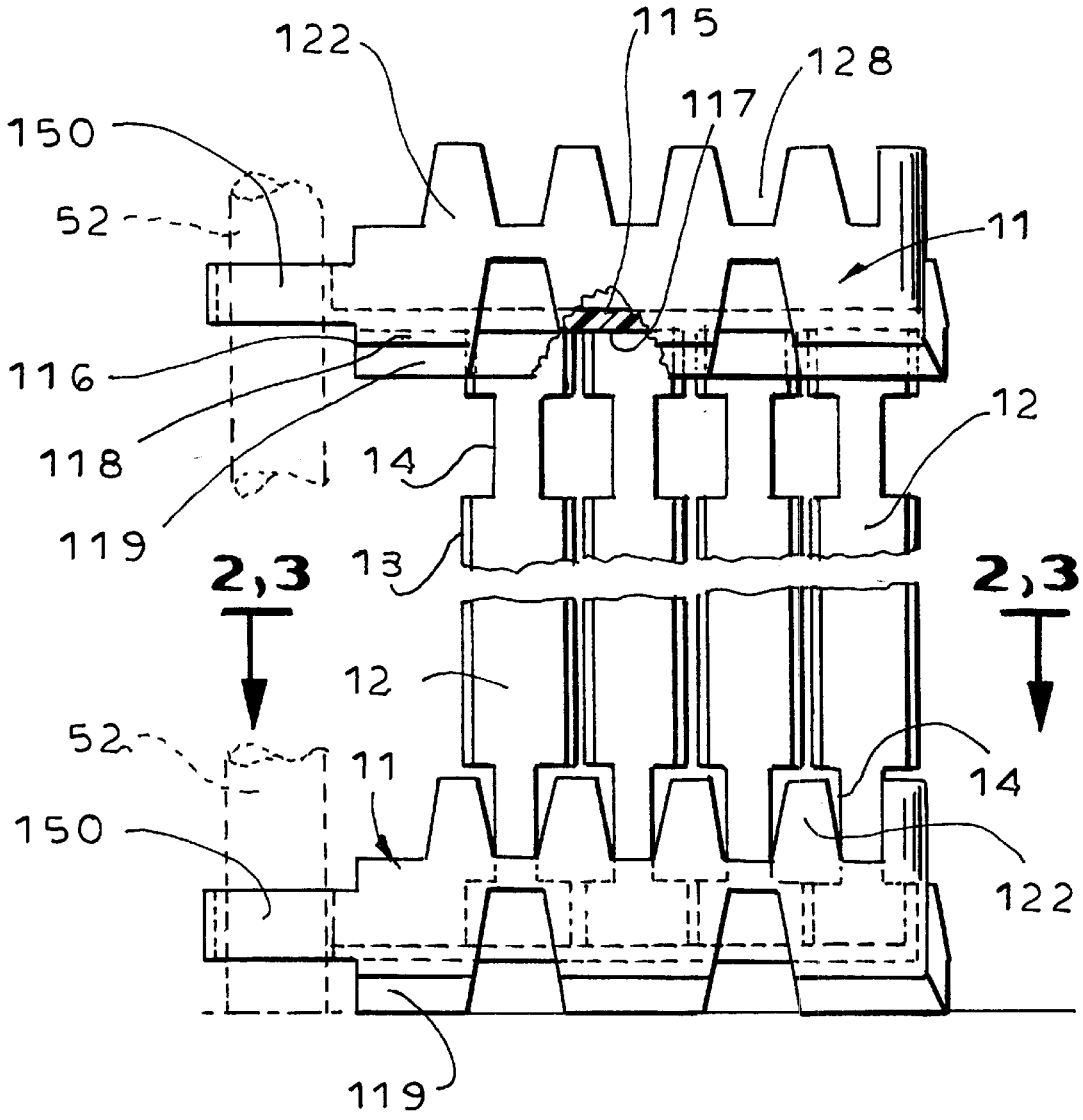
FIG. 1 is a side elevational view of a tower-like structure formed of vertically oriented log elements in conjunction with upper and lower construction elements according to the invention.
Figure 2:
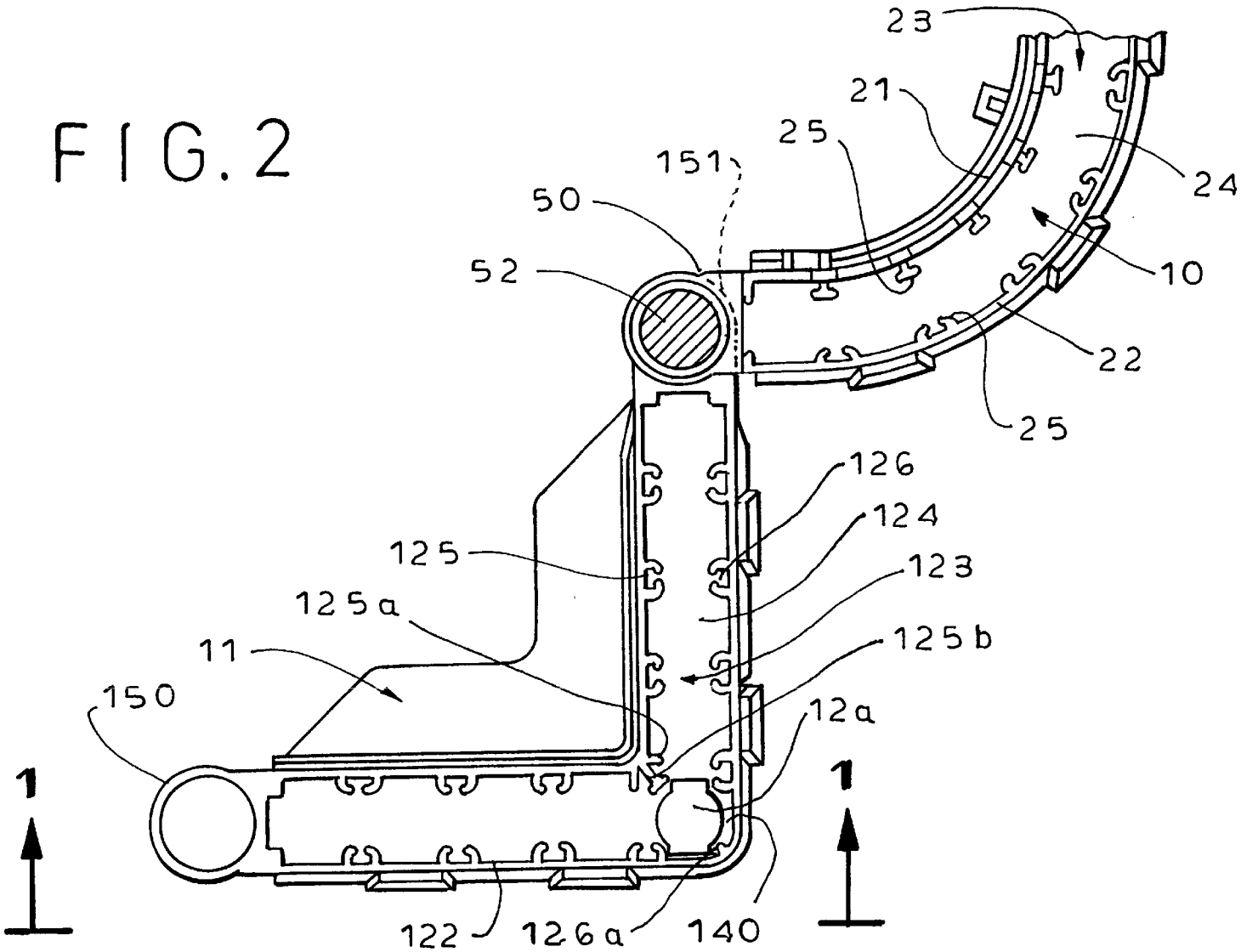
FIG. 2 is a top plan view illustrating a form of right angular construction element according to the invention, and a portion of a semicircular fitting.

FIGS. 1 and 2 of the drawings illustrate a construction fitting 11 which is of right angular configuration, but is otherwise largely similar to the previously described construction element 10. The element 11 is formed with a horizontal platform 115 supported by a base 116 comprised of upper wall portions 118 and flared lower wall portions 119 defining a downwardly opening channel 117 corresponding to the channel 17 of FIG. 4.

Inner and outer walls 121, 122 extend upward, above the platform 115, and form an upwardly opening channel 123. The channel 123 is divided by inner and outer partitioning elements 125, 126 to form sockets 124 for the reception of end portions of log elements 12, substantially in the manner indicated in FIGS. 4–6. In the case of the semicircular construction element 10, the inner and outer partitioning elements 25, 26 are of somewhat different configuration, deriving from the fact that the arcuate contour of the semicircular element requires the partitioning elements to be greater width along the outer wall 22 than along the inner wall 21. In the case of the right angular construction element 11, the spacing along rectilinear portions of the channel 123 are the same along the inside and outside walls 121, 122, and the respective partitioning elements 125, 126 are therefore preferably of the same size and configuration. In the corner area 140, special partitioning 125*a* and 125*b* and 126*a* are provided to accommodate the installation of a log element 12*a* at the corner>

As in the case of the semicircular construction element 10, a structure may be formed with the construction element 11 by inserting a plurality of vertically oriented log elements 12 into all or a plurality of the individual sockets 124. A second construction element 11 may be placed over the tops of the previously installed log elements 12, to form a tower-like structure.

As in the case of the semicircular construction element 10, the right angular construction element 11 advantageously is formed with its upper wall portions 121, 122 notched out at 128, between partitioning elements, such that the complete assembly of upper and lower construction elements 11, connected by vertically oriented logs 12, gives the appearance of a castle tower or the like.

To advantage, each of the construction elements 10, 11 is provided at opposite ends with a joining ring 50, 51, in the case of the semicircular element 10 and 150, 151, in the case of the right angular elements 11. The joining rings at opposite ends of a given construction element are offset vertically, such that a plurality of elements, of the same or of a different type, may be joined together by sliding one of the joining rings underneath the other, in the manner reflected in FIGS. 1 and 3, for example. The parts may be then positively joined by inserting a dowel, or a longer rod element, as indicated generally at 52 in FIGS. 1 and 3.

It will be readily apparent from the foregoing, that construction elements incorporating principles of the invention may be made in a variety of shapes, sizes and configurations. Additionally, while a most advantageous form of the invention involves upper and lower construction elements associated with vertically oriented log elements, it is within the contemplation of the invention that the construction elements may be arranged to engage log elements in horizontal or other orientations to provide structures formed of a combination of the logs and the construction elements.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A toy log construction set which comprises, (a) a plurality of individual toy log elements of predetermined thickness provided at each end thereof with opposed notches of a size and shape to interfit with similar notches of log elements oriented at 90° with respect thereto, suitable for the construction of log assemblies of interleaved, horizontally disposed log elements alternately disposed at right angles to each other, and (b) structure-forming elements of molded plastic construction having a platform and a plurality of outwardly opening sockets, adjacent to said platform for the end-wise reception and support of parallel oriented log elements in side-by-side relation.

2. A toy construction set according to claim 1, wherein (a) said structure-forming elements are tower-forming elements having a base portion including said platform and upwardly opening sockets for end-wise reception of vertically oriented log elements, (b) the base portions of said tower-forming elements including downwardly opening recesses of a size and shape to receive upper end portions of said vertically oriented log elements.

3. A toy construction set according to claim 2, wherein (a) said upwardly opening sockets are formed in part by spaced apart, upwardly projecting wall sections having spaced apart notches to provide a castellated configuration, and (b) a second tower-forming element adapted when placed in normal orientation upon the tops of a plurality of vertically oriented logs, to form a castellated tower structure.

4. A toy construction set according to claim 1, wherein (a) said structure-forming element is provided with spaced apart side walls defining a continuous channel, (b) said channel being divided by partitioning elements to form said outwardly opening sockets, (c) said log elements are of generally circular configuration provided on opposite sides with flat surface projections defining narrow side edge surfaces, and (d) said partitioning elements being positioned to engage said narrow side edge surfaces when said log elements are received in said sockets, to prevent rotation of said log elements.

5. A toy construction set according to claim 4, wherein (a) said side walls are spaced apart a distance slightly greater than the distance between opposed flat surface projections of a log element whereby, when a log element is inserted in a socket with its flat surface projections parallel to said side walls, said log element is prevented from rotation by interaction between said side walls and said flat surface projections.

6. A toy construction set according to claim 1, wherein (a) said structure-forming elements are provided at opposite ends thereof with joining elements for connecting a plurality of said structure-forming elements in a continuous structure.

7. A toy construction set according to claim 6, wherein (a) said joining elements are of generally closed configuration, (b) the joining element at one end of a structure-forming element being offset vertically from the joining element at the other end whereby, in a joined series of structure-forming elements, the joining element of one such structure-forming element is positioned above or below the joining element of an adjacent structure-forming element for the reception of a vertically oriented connecting element.

* * * * *